US006174851B1

(12) United States Patent
Harth et al.

(10) Patent No.: US 6,174,851 B1
(45) Date of Patent: Jan. 16, 2001

(54) PROCESS FOR THE PRODUCTION OF DETERSIVE GRANULES

(75) Inventors: Hubert Harth, Perchtoldsdorf; Franz Pfeifer, Vienna; Gisela Nitsch, Bisamberg; Johann Seif, Senftenberg; Herbert Senger; Petra-Stefanie Madle, both of Vienna, all of (AT)

(73) Assignee: Henkel Kommanditgesellschaft Auf Aktien, Duesseldorf (DE)

( * ) Notice: Under 35 U.S.C. 154(b), the term of this patent shall be extended for 0 days.

(21) Appl. No.: 09/466,594

(22) Filed: Dec. 17, 1999

(30) Foreign Application Priority Data

Dec. 19, 1998 (DE) ..... 198 58 859

(51) Int. Cl.[7] ..... C11D 11/00

(52) U.S. Cl. ..... 510/444; 510/451; 510/495; 264/117; 264/140

(58) Field of Search ..... 510/444, 451, 510/495; 264/117, 140

(56) References Cited

U.S. PATENT DOCUMENTS

| | | | | |
|---|---|---|---|---|
| 3,597,361 | * | 8/1971 | Sumner | 510/444 |
| 4,676,658 | * | 6/1987 | Herfeld | 366/197 |
| 4,867,972 | * | 9/1989 | Girardeau et al. | 424/81 |
| 4,919,847 | * | 4/1990 | Barletta et al. | 510/442 |
| 5,164,108 | * | 11/1992 | Appel et al. | 510/444 |
| 5,490,954 | * | 2/1996 | Van Der Hoeven et al. | 510/444 |
| 5,576,285 | * | 11/1996 | France et al. | 510/444 |
| 5,641,741 | * | 6/1997 | Emery et al. | 510/457 |
| 5,703,037 | * | 12/1997 | Doumen et al. | 510/444 |
| 5,736,501 | * | 4/1998 | Yamashita et al. | 510/444 |
| 5,855,625 | * | 1/1999 | Maurer et al. | 8/137 |
| 5,929,021 | * | 7/1999 | Dhanuka et al. | 510/444 |

FOREIGN PATENT DOCUMENTS

| | | | |
|---|---|---|---|
| 196 51 072 | | 6/1998 | (DE) . |
| 198 18 966 | | 11/1999 | (DE) . |
| 1151766 | * | 5/1969 | (GB) . |
| 58/217598 | | 12/1983 | (JP) . |
| WO93/23520 | | 11/1983 | (WO) . |
| WO90/13533 | | 11/1990 | (WO) . |
| WO97/21487 | | 6/1997 | (WO) . |

OTHER PUBLICATIONS

SOEFW, 99 (1973) pp. 358–359.
SOEFW, 94, (1968) pp. 234–235.

* cited by examiner

*Primary Examiner*—Lorna M. Douyon
(74) *Attorney, Agent, or Firm*—Wayne C. Jaeschke; Glenn E. J. Murphy

(57) ABSTRACT

Storage-stable homogeneous granules with detersive properties, which are obtained by agglomeration of one or more solids with one or more granulation liquids in a free-fall mixer divided into a mixing zone and a post-mixing zone and comprising a knock-down bar fixed to an end plate from which it crosses the entire mixing zone and optionally extends into the post-mixing zone and are optionally aftertreated, may be produced by in situ neutralization of anionic surfactant acids. The products thus produced show distinct performance advantages, the process also having cost-efficient aspects.

28 Claims, No Drawings

PROCESS FOR THE PRODUCTION OF DETERSIVE GRANULES

BACKGROUND OF THE INVENTION

This invention relates to an improved process for the production of detersive granules and to a detergent which consists predominantly of the conventionally formulated granules thus produced.

Although the trend today is increasingly towards heavy detergents with bulk densities of 650 g/l and higher, preferably above 700 g/l, there is still a demand for detergents with bulk densities below 700 g/l. Above all in parts of the world where handwashing still plays an important part or where, for example, tub-type washing machines are still predominantly used for machine washing, the detergents used are expected to dissolve quickly without excessive mechanical assistance. In the case of mixed and granulated products, this has hitherto been achieved through the reduced bulk density of the detergents.

Modern detersive granules are normally expected to show adequate stability in storage in regard to the flowability of the granular products. Today, this requirement is normally satisfied with the optional assistance of so-called surface modifiers which cover the surface of the granules and prevent them from sticking to one another. However, another requirement, namely producing a macroscopically homogeneous product, which does not undergo any separation during production or packaging and which does not show any separation of specifically different powder qualities, by mixing and granulation in order to prevent separation of the individual components during transportation or storage, can still present the expert with problems depending on the raw materials used and the apparatus available. If the need for a certain bulk density coupled with high formulation variability is then added as yet another requirement, the expert is obliged to make compromises among the various possibilities hitherto available.

Although relatively free-flowing and homogeneous products are obtained in conventional spray drying processes, hydrolysis-sensitive or temperature-sensitive detergent ingredients, for example peroxy bleaching agents or enzymes, have to be subsequently incorporated. Since the direct spray drying product normally has bulk densities of only 300 to 550 g/l, it has to be converted into granular form if higher bulk densities are required, as sufficiently well-known from the patent literature. If heavy ingredients are merely incorporated by mixing, an increase in bulk density is certainly obtained, but only at the expense of a risk of separation during transportation and storage. In addition, spray drying is a cost-intensive process, so that it is economically unfavorable to produce the principal component of a detergent by spray drying.

In addition, it is generally known that the content of anionic surfactants in particular in spray-dried granules has to be limited both for production and safety reasons (risk of fire) and for applicational reasons (lump formation). For example, spray-dried granules containing more than 20 to 25% by weight of alkyl benzenesulfonates have a marked tendency to form lumps. Accordingly, highly concentrated granules containing anionic surfactants cannot be produced by spray drying.

Various mixers and granulators in which either heavy or relatively light granules can be produced are available today. Thus, a high bulk density is obtained, for example, in a L ödige plowshare mixer (in approximate terms, the bulk density predicted by the normal method of calculation "sum of the percentages by weight of the individual solid raw materials multiplied by their bulk densities and the liquid components multiplied by their density" is obtained or the bulk densities are only slightly lower than that value if the mixer is efficiently operated), although agglomeration is normally inadequate so that inhomogeneous granules and a relatively broad particle size range with coarse and fine particle components are obtained. In addition, the relatively coarse-particle solids used undergo at least partial destruction. These products tend to separate.

Whereas mixers and granulators, such as the plowshare mixer, can be characterized by rotating tools, the so-called free-fall mixers are distinguished by the fact that they do not contain any tools and belong to the mixers with rotating containers. In free-fall mixers, the product being mixed is lifted by friction with the wall or internals and "trickles" back down onto the surface of the pile under the effect of gravity.

In so-called double-cone mixers, which belong to the free-fall mixers and in which detersive granules with bulk densities that confirm the theoretical calculation are normally obtained, the solid ingredients are gently mixed without particle destruction in contrast to the plowshare mixer. Unfortunately, the product remains inhomogeneous which is an indication of inadequate agglomeration.

Apart from a few exceptions where paste-form starting materials are granulated, one or more solids is/are normally processed with the assistance of granulation liquids in the process of mixing and agglomeration. Thus, International patent application WO-A-97/21487, for example, describes a process for the production of detersive granules in which water or aqueous solutions and/or aqueous dispersions are only added in such quantities that the water binding capacity of the final stable granules is not exceeded. The bulk densities of the embodiments mentioned in the Examples are between 650 g/l and 780 g/l. There is no reference to the homogeneity of the product or to an optionally adjustable bulk density of the granules. However, the preferred choice of mixers/granulators which accommodate a high energy input suggests that, for a given formulation, the bulk densities are not freely adjustable and/or the final granules show distinct inhomogeneities in accordance with the foregoing observations.

Another problem lies in the homogeneous incorporation of minor components which are only used in small quantities, for example in quantities of up to about 10% by weight, in a detergent. These minor components include co-builders, optical brighteners, sequestering agents, redeposition inhibitors, soap, dyes and perfumes, etc. German patent application DE-A-196 51 072 suggests accommodating minor components of the type in question in a separate additive, the use of this additive providing for more exact dosing and for more homogeneous distribution of the minor components throughout the detergent.

The two above-cited documents alone show that mixed products normally contain basic granules to which several other components are subsequently added or that several compounds (each containing at least two detersive ingredients) are separately produced and subsequently mixed, optionally with incorporation of other raw materials. Typical added components are, for example, peroxy bleaching agents, such as perborate and/or percarbonate, which can have bulk densities of 800 to 1000 g/l, or sodium sulfate which has a bulk density of up to 1500 g/l and which may still be present in quantities of up to 45% by weight in some detergents. Even optionally heavy sodium carbonates or bleach activators are suitable as added components. The added components mentioned with bulk densities above 700 g/l can be incorporated relatively easily in heavy detergents. However, in detergents expected to have bulk densities below 650 g/l, not only must the other components have a correspondingly lower bulk density, there is also a serious risk of separation due to the differences in bulk density between the individual granular components. In the case of heavy sodium sulfate, there is the further complication that sodium sulfate consists of relatively fine particles and tends in any case to sink to the bottom of detergent packs during storage and above all during transportation.

Tetraacetyl ethylenediamine (TAED), which is still the most commonly used bleach activator, has bulk densities of only 500 to 600 g/l. However, in detergents which have a bulk density of only 400 g/l, even TAED is regarded as a heavy and hence difficult-to-handle raw material.

Now, the problem addressed by the present invention was to enable detersive granules which, besides showing adequate stability in storage (flowability), would above all be homogeneous to be produced by mixing and agglomeration. Above all heavy ingredients with bulk densities above the required bulk density of the end product would lend themselves to processing without the end products showing any tendency to separate.

DESCRIPTION OF THE INVENTION

According to the invention, the solution to this problem is characterized in that one or more solids, which are ingredients of detergents, and one or more granulation liquids are agglomerated in a rotatable container without mixing tools, which is divided up into a mixing zone and a post-mixing zone and which comprises a knock-down bar fixed to an end plate from which is crosses the entire mixing zone and optionally extends into the post-mixing zone, and are optionally aftertreated, the anionic surfactants present in the end product of the process being introduced into the process at least partly in the form of the anionic surfactant acid or the anionic surfactant acids.

Suitable rotatable mixers without mixing tools used in accordance with the invention are described in hitherto unpublished German patent application DE 198 18 966. Reference is hereby expressly made to the disclosure of this German patent application. The rotatable container without any internal mixing tools to be used in accordance with the invention is preferably a conical mixing drum which is horizontally arranged but, in one advantageous embodiment, may be inclined towards the horizontal. The angle of inclination $\alpha$ is less than 45°, angles of inclination of less than 20° having proved to be particularly effective. The mixing drum is divided in two so that an actual mixing zone and a post-mixing zone are formed. In one advantageous embodiment of the invention, the ratio between the length of the mixing zone and the length of the post-mixing zone is at least 1:1, but preferably (70–55):(30–45). The mixing drum has at least one inlet for solids, the solids being delivered in particular to the relatively large circular surface. In addition, the mixing drum also has at least one inlet for the introduction of liquids, more particularly in the form of nozzles, advantageously 1 to 5 nozzles, different granulation liquids being introduced through different nozzles although one and the same granulation liquid may also be added through various nozzles. One-component nozzles are as suitable as multi-component nozzles and/or spraying with gases, more particularly air or steam, as an auxiliary. If, for example, two different nonionic surfactants, such as $C_{12-18}$ alcohol containing 7 EO and $C_{12-14}$ alcohol or $C_{12-15}$ alcohol containing 3 EO, are used as granulation liquids, they may be introduced into the process either in the form of a mixture through a two-component nozzle or through two nozzles.

A preferred of the invention is characterized in that the relatively large circular surface of the mixing drum is formed with the inlet for solids around which the various nozzles are then arranged. Liquid minor components may also be homogeneously distributed in this way.

The mixing drum is preferably divided into the mixing zone and the post-mixing zone by the drive, for example by a toothed rim.

The key component of the mixing drum for the process according to the invention is a knock-down bar which is fixed to the end plate of the first part of the mixer and which, from there, crosses the entire mixing zone and preferably extends into the post-mixing zone, but advantageously does not go beyond half the length of the post-mixing zone. In one particularly preferred embodiment, the knock-down bar only extends into the first third of the post-mixing zone. The knock-down bar itself may have a width of, for example, 50 to 150 mm and preferably 75 to 130 mm. The upper edge of the knock-down bar is at a distance from the inner wall of the mixer which preferably makes up at most 10% of the smallest diameter of the drum in the mixing zone, preferably at most 5% of the smallest drum diameter of the mixing zone and, more particularly, 5 to 25 mm and advantageously less than 20 mm, for example 5 to 15 mm. In the post-mixing zone, the distance to the nearest inner wall of the mixer can be greater than in the mixing zone. Values of 100 to 300 mm are entirely normal.

Apparatus similar to that shown in FIG. 1 of German patent application DE 198 18 966, which may also be used, are described for example in SÖFW, Vol. 99, pages 239 358 to 359 (1973) and in SÖFW, Vol. 94, pages and 235 (1968).

After passing through the post-mixing zone, the end product may either be directly discharged via the discharge unit and the outlet or may be further treated via the feed system, in which case other powders, more particularly surface modifiers of the universally known type, may be added via the inlet for solids. If this feed and metering screw extends into the post-mixing zone (the feed screw could also be directly connected to the discharge unit), the screw preferably only extends at most into the second half of the post-mixing zone and, hence, not into that part of the post-mixing zone in which the knock-down bar is still present. In one particular embodiment of the invention, the knock-down bar is mounted on the screw.

Suitable powdering agents or surface modifiers are any of the known fine-particle representatives of this group of auxiliaries. Amorphous and/or crystalline alumosilicates, such as zeolite A, X and/or P, various types of silicas, calcium stearate, carbonates, sulfates, and also fine-particle compounds, for example of amorphous silicates and carbonates, are preferably used.

According to the invention, the anionic surfactants present in the end product of the process are introduced into the process at least partly in their acid form and are at least partly and preferably completely neutralized in situ. The advantage of this on the one hand is that the process costs for the mixing process are more favorable than for spray drying; on the other hand, relatively large quantities of anionic surfactants and also nonionic surfactants can be introduced into the end product of the process without suffering any loss of flowability. In one preferred embodiment of the invention, all anionic surfactants except for any soaps present are introduced into the process in their acid form. The anionic surfactants in question are, in particular, alkyl benzenesulfonic acids, for example $C_{9-13}$ alkyl benzenesulfonic acid or $C_{12}$ alkyl benzenesulfonic acid, and also alkyl sulfuric acid semiesters, such as fatty alkyl sulfuric acid semiesters which, because they are unstable, are preferably further processed in the process according to the invention immediately after their production. $C_{12-18}$ alkyl sulfuric acid semiesters are particularly preferred, chain cuts with predominantly $C_{12-16}$ and more particularly $C_{12-14}$ components being most particularly preferred. However, alkyl sulfuric acid semiesters with odd chain lengths, for example with $C_{13-15}$ alkyl chains which may optionally be ethoxylated, may also be used. Olefin sulfuric acid semiesters or alkanesulfonic acids are also suitable. A particularly preferred embodiment is characterized by the use of alkyl benzenesulfonic acid because it is precisely alkyl benzenesulfonic acid or alkyl benzenesulfonate which often causes production difficulties through sticking of the products in spray drying processes.

In another preferred embodiment of the invention, soap-containing products are produced by the process according to the invention. The soaps may also be introduced into the process in the form of their free acids. In that case, the fatty acids are advantageously introduced into the process in admixture with another anionic surfactant acid, for example with alkyl benzenesulfonic acid. Mixtures of fatty acids, other anionic surfactant acids and nonionic surfactants, which are described for example in WO-A-93/23520, may also be used.

In one particular embodiment of the invention, only part of the anionic surfactant acid is introduced into the process as a liquid, more particularly by spraying onto a solid or onto a mixture of solids, while the other part is converted into a solid form, for example into a compound, the anionic surfactant acid(s) being used in quantities of about 10 to 60% by weight. Compounds of the type in question are produced, for example, by neutralizing the liquid anionic surfactant acid, preferably with liquid neutralizing agents, such as sodium hydroxide, and then subjecting it to a drying process, preferably to a spray drying process, optionally together with other ingredients. Accordingly, the compounds themselves are predominantly neutral or alkaline rather than acidic in character. Other ingredients of such compounds may be typical detergent ingredients, including in particular inorganic and organic builders and also minor components, such as optical brighteners and phosphonates.

The partial or complete neutralization of the anionic surfactant acids, including any fatty acids present which are counted as anionic surfactant acids in the context of the present invention, may be carried out with a basic, inorganic or organic, aqueous or non-aqueous neutralization medium. In principle, the organic neutralization medium may be selected from any basic organic substances which are preferably typical ingredients of solid or liquid detergents. Liquid organic neutralization media, which may also serve as agglomeration auxiliaries, are advantageously used, particularly for complete neutralization. Preferred liquid organic neutralization media are amines, more particularly dimethyl amine and mono-, di- and triethanolamine.

However, inorganic neutralization media which may be present in solid form or in the form of an aqueous solution are preferably used. Solid sodium hydroxide or an aqueous sodium hydroxide solution, more particularly a concentrated 40 to 60% by weight aqueous sodium hydroxide solution, is preferably used as the inorganic neutralization medium. In principle, highly concentrated aqueous sodium hydroxide solutions are preferred. In one advantageous embodiment, the aqueous sodium hydroxide solution is also sprayed into the mixing zone and may also serve as an agglomeration aid. Accordingly, only those concentrated sodium hydroxide solutions which can be sprayed, optionally after heating, may be used.

In one preferred embodiment of the invention, the anionic surfactant acids are at least partly neutralized by a liquid neutralization medium, more particularly an aqueous inorganic solution. In order to keep the quantities of water introduced relatively small, complete neutralization is preferably carried out partly with alkaline solids, for example sodium carbonate and/or potassium carbonate and/or phosphates.

Depending on the other constituents of the formulation, at least aliquot molar quantities of an aqueous sodium hydroxide solution, based on the quantity of anionic surfactants used in their acid form, are preferably used and sprayed into the mixer.

In one preferred embodiment, the quantity of anionic surfactant acids sprayed in is between 0.2 and 20% by weight, preferably between 0.5 and 10% by weight and more preferably between 1 and 6% by weight of the formulation as a whole. If the quantity of anionic surfactant acids sprayed in is at least 15% by weight of the formulation as a whole, it is particularly preferred to use less than the aliquot quantity of liquid neutralization medium, more particularly aqueous alkaline solutions.

Raw materials and/or compounds may be used as the solids. According to the invention, compounds contain at least two different ingredients normally used in detergents and have been prepared in advance by standard techniques, such as spray drying, granulation, roller compacting or extrusion. The raw materials used may consist of fine particles or even relatively coarse particles, the process according to the invention having the advantage that even relatively fine-particle material can be processed without any difficulty. Since the production and subsequent further processing of compounds can be economically quite unfavorable, it is preferred in one embodiment of the invention to use only 1 to 3 different compounds as solids. In another embodiment of the invention, one of these preferred compounds is the already described compound which contains anionic surfactants. In one particularly preferred embodiment, at least one other solid raw material is used in addition to the compounds as a solid additive intended for the compounds. In another particularly advantageous embodiment, no spray-dried compounds are introduced into the process. It is even possible to use no compounds at all, but only solid raw materials as the solids. The process according to the invention affords the advantage that even so-called solid minor components may be directly incorporated. This may be done, for example, by weighing the solids together on a conveyor belt, a so-called component collecting belt, and adding the solid minor components, more particularly those which are used in quantities of only at most 2% by weight, to the mixer as the last solid or last solids immediately before introduction of the solids. Accordingly, there is no need in the process according to the invention for separate premixing of the solids in a separate mixer, i.e. for the preparation of a so-called premix which is standard practice in other processes.

Since it is preferred for economic reasons not to add a drying step onto the agglomeration process or onto the optional treatment step, but to add water in the agglomeration phase and since the end products of the process are intended not to adhere to one another, it is preferred in another advantageous embodiment of the invention to use at least one overdried solid (raw material or compound), so that the total water content of the solids or solids mixture used is lower than corresponds to the water binding capacity of the total solids or solids mixture. In another preferred embodiment of the invention, the aqueous granulation liquid is only used in such quantities that the water binding capacity of the agglomerates is not exceeded. Particulars of the determination of the water binding capacity and the addition of aqueous granulation liquids to solids, with the proviso that the water binding capacity of the end products should not be exceeded, can be found in the disclosure of International patent application WO-A-97/21487.

The solid starting materials used may be any of the raw materials and/or compounds typically used in solid or solidified form in detergents, more particularly anionic, nonionic, cationic and/or amphoteric surfactants, inorganic and organic builders and organic builder acids, peroxy bleaching agents, bleach activators and bleach catalysts, inorganic salts showing an alkaline reaction in water, such as sodium or potassium (bi)carbonate, amorphous or crystalline sodium silicates, neutrally reacting salts, such as sodium or potassium sulfate, and salts showing an acidic reaction, such as sodium or potassium bisulfate, enzymes, redeposition inhibitors, discoloration inhibitors, soil repellents, foam inhibitors, complexing agents, for example phosphonates, and optionally optical brighteners and pH regulators. A more detailed description of these ingredients can be found in the extensive patent literature on the subject of detergents. It is also left to the expert to decide which of the solid ingredients he would prefer to use as raw materials or as preformed compounds. In addition to the anionic surfactant acids used in accordance with the invention, which are mostly present in liquid form, anionic surfactants introduced into the process either in powder form or in precompounded form, but occasionally as an aqueous paste, may be used as solids. So-called highly concentrated surfactant compounds with surfactant contents of at least 30% by weight, preferably at least 50% by weight, based on the compound, which may be granulated for example in a fluidized bed, are advantageously used.

In one particularly preferred embodiment, heavy solids which are often subsequently incorporated for various reasons are introduced into the agglomeration process. These heavy solids include sodium sulfate, which even today is still present in the detergents in quantities of up to 45% by weight in some countries, sodium carbonate and sodium bicarbonate and peroxy bleaching agents, such as perborate monohydrate, perborate tetrahydrate and/or percarbonate. Granulated bleach activators, which often have a bulk density of 500 to 600 g/l, also count as heavy ingredients in detergents which, as required, should have a bulk density below 500 g/l and may also be used in the process according to the invention. The bleaching agent and bleach activator may advantageously be introduced into the process together without any danger of bleaching activity being lost despite the use of water as agglomeration or granulation liquid. The same applies to granulated enzymes and/or granulated foam inhibitors.

Besides the usual spray dried compounds, which have been used for some time as basic granules, more particularly for detergents with bulk densities below 600 g/l and also as a starting compound for other compacting granulation or extrusion processes and which often contain all the components of the final detergent that are not sensitive to hydrolysis and/or heat, the compounds preferably used include those which contain 10 to 75% by weight of organic components, such as surfactants, co-surfactants (also known as detergency boosters) and, in particular, organic builders and co-builders, more particularly polymeric and/or copolymeric salts, for example of acrylic acid and/or maleic acid. One advantage of the process according to the invention is that as few spray dried components as possible and, in particular, no spray dried granules at all need be used, so that the process as whole is very cost-efficient compared with spray drying or with processes in which large amounts of spray dried components are processed.

Another advantageous compound is a so-called builder compound which predominantly contains inorganic components and, accordingly, inorganic builders. They may be adjusted to an alkaline or acidic pH value as required through the choice of the builders. One advantageous embodiment of the invention is characterized by the use of builder compounds which contain at most 30% by weight and preferably up to 20% by weight of organic constituents, more particularly anionic surfactants and/or nonionic surfactants. Particularly preferred embodiments are characterized by only 2 to 15% by weight of organic constituents, above all anionic surfactant. Special embodiments of such builder compounds are, in particular, compounds of carbonates and silicates which optionally contain up to 30% by weight and preferably up to 20% by weight of surfactants, more particularly anionic surfactants, but also anionic surfactants and nonionic surfactants. Particularly preferred builder compounds contain between 40 and 70% by weight of sodium carbonate, 20 to 50% by weight of sodium silicate with a modulus of 2.0 to 3.3 and, optionally, about 2 to 18% by weight of anionic surfactant, more particularly alkyl benzenesulfonate. Another interesting compound essentially contains zeolite, crystalline layered sodium disilicate and polymeric polycarboxylate or crystalline layered sodium disilicate and citric acid.

In one preferred embodiment of the invention, a compound with high contents of organic components, such as surfactants and, optionally, organic co-builders and a builder compound which is intended to establish the alkalinity in the end product required for washing are combined with one another. These two compounds are preferably used in ratios by weight of 5:1 to 1:3 and, more particularly, 3:1 to 1:1.

In another preferred embodiment, however, only a single compound is used while the other solids are all introduced into the process as commercially available raw materials. In particular, no compounds containing alkyl benzenesulfonate are used. In these embodiments, the economic aspect is particularly effective.

Perfumes on the one hand may be introduced into the process in liquid form as a granulation liquid, as described above. However, the process is also suitable for processing perfumes in the form of solid compounds. Concentrated perfume compounds such as these may be separately prepared, for example, by granulation, compacting, extrusion, pelleting or by other agglomeration processes. Cyclodextrins for example has been successfully used as support materials, the cyclodextrin/perfume complexes optionally being coated with other auxiliaries. The separate production of perfume compounds is described, for example, in earlier German patent application DE-A-197 46 780.6 which discloses a process in which a solid and substantially water-free premix of a) 65 to 95% by weight of carrier(s), b) 0 to 10% by weight of auxiliary(ies) and c) 5 to 25% by weight of perfume is subjected to granulation or press agglomeration. Preferred carriers are selected from the group of surfactants, surfactant compounds, di- and polysaccharides, silicates, zeolites, carbonates, sulfates and citrates and are used in quantities of 65 to 95% by weight and preferably 70 to 90% by weight, based on the weight of the perfume compounds formed.

The total surfactant content of the final composition may vary as usual over a wide range, for example from 5 to 40% by weight, based on the final composition. As already mentioned, anionic surfactants are preferably introduced into the mixture to be agglomerated as solids while nonionic surfactants may be added both as part of the solids (compounds) and as an agglomeration aid. The ratio by weight of anionic surfactants to nonionic surfactants in the final compositions may be between 10:1 and 1:10. In preferred embodiments, however, it is above 1 and, more particularly, even above 1.5:1, for example 5:1 or 8:1.

Liquid agglomeration aids and granulation aids are normally used for the production of agglomerates. The liquid anionic surfactant acids and the water formed during neutralization, for example, are used as such aids. However, it has already been pointed out that some raw materials may also be used in the form of aqueous solutions or dispersions. Accordingly, these aqueous solutions or dispersions may also serve as agglomeration and granulation aids. A more detailed description of which aqueous or even non-aqueous agglomeration or granulation aids may be used can be found in the disclosure of hitherto unpublished German patent application DE 198 18 966 where is it expressly stated that four or five different granulation liquids, possibly even more, may readily be used.

In another advantageous embodiment of the invention, liquid agglomeration or granulation aids are introduced into the process in quantities of 0.5 to 15% by weight, preferably in quantities of 1 to 10% by weight and more preferably in quantities of 1.5 to 7% by weight. If granulation liquids are mentioned hereinafter, they are meant to be the liquid agglomeration and granulation aids. Accordingly, these expressions are used synonymously in the context of the present invention.

Suitable non-aqueous granulation liquids are, in particular, liquid or liquefied or molten nonionic surfactants, paraffins, silicone oils, perfumes, fatty acids, fusible polyesters and known soil-release ingredients of detergents.

Preferred liquid or liquefied nonionic surfactants are alkoxylated, advantageously ethoxylated, more especially primary alcohols preferably containing 8 to 18 carbon atoms and, on average, 1 to 20 moles of ethylene oxide (EO) per mole or alcohol and, more particularly, up to an average of 14 EO per mole of alcohol, in which the alcohol component may be linear or preferably 2-methyl branched or may contain linear and methyl-branched groups in the form of the mixtures typically present in oxo alcohol residues. However, alcohol ethoxylates with linear residues of alcohols of native origin containing 12 to 18 carbon atoms, for example of cocofatty alcohol, palm oil fatty alcohol, palm kernel oil fatty alcohol, tallow fatty alcohol or oleyl alcohol, and an average of 2 to 8 EO per mole of alcohol are particularly preferred. Preferred ethoxylated alcohols include, for example, $C_{12-14}$ alcohols and $C_{12-15}$ alcohols containing 3 EO or 4 EO, $C_{9-11}$ alcohols containing 7 EO, $C_{13-15}$ alcohols containing 3 EO, 5 EO, 7 EO or 8 EO, $C_{12-18}$ alcohols containing 3 EO, 5 EO or 7 EO and mixtures thereof, such as mixtures of $C_{12-14}$ alcohol or $C_{12-15}$ alcohol containing 3 EO and $C_{12-18}$ alcohol containing 7 EO. The degrees of ethoxylation shown are statistical mean values which, for a special product, may be a whole number or a broken number. Preferred alcohol ethoxylates have a narrow homolog distribution (narrow range ethoxylates, NRE).

Another class of preferred nonionic surfactants, which may be used either as sole nonionic surfactant or in combination with other nonionic surfactants, more particularly together with alkoxylated fatty alcohols and/or alkyl glycosides, are alkoxylated, preferably ethoxylated or ethoxylated and propoxylated fatty acid alkyl esters, preferably containing 1 to 4 carbon atoms in the alkyl chain, more particularly the fatty acid methyl esters which are described, for example, in Japanese patent application JP 58/217598 or which are preferably produced by the process described in International patent application WO-A-90/13533. $C_{12-18}$ fatty acid methyl esters containing on average 3 to 15 EO and, more particularly, an average of 5 to 12 EO are particularly preferred.

Suitable fatty acids are, in particular, saturated fatty acids, such as lauric acid, myristic acid, palmitic acid, stearic acid, hydrogenated erucic acid and behenic acid and, in particular, mixtures derived from natural fatty acids, for example cocofatty acid, palm kernel oil fatty acid or tallow fatty acid.

Since the quantity of water optionally added depends upon the particular case, it is not possible to indicate specific quantities which always produce the required result. In one preferred embodiment of the invention, however, the quantity of water introduced as granulation liquid is between 0.5 and 10% by weight and, more particularly, between 1 and 7% by weight, based on the mixture as a whole, depending on the mixture to be agglomerated. It is irrelevant whether the water is introduced into the process as a sole raw material or in the form of an aqueous solution or in the form of an aqueous dispersion. However, since no drying step is preferably added onto the agglomeration process, water is preferably not used as sole agglomeration aid in order to keep the quantity of water introduced as small as possible.

Preferred aqueous solutions are those of inorganic and/or organic builders. Accordingly, solutions of alkali metal silicates, alkali metal carbonates and of polycarboxylates, for example citrates, (co)polymeric polycarboxylates and cellulose ethers, such as carboxymethyl celluloses or methyl celluloses, are particularly suitable. However, water-containing surfactant pastes of anionic and/or nonionic surfactants also represent suitable granulation liquids. For example, highly concentrated pastes of alkyl benzenesulfonates and alkyl sulfates may be used. Another particularly preferred embodiment is characterized by the use of nonionic surfactant pastes, such as pastes of alkyl glycosides, polyhydroxyfatty acid amides or the fatty acid methyl ester ethoxylates mentioned above.

Alkyl glycosides are surfactants corresponding to the general formula $RO(G)_x$, where R is a primary linear or methyl-branched, more particularly 2-methyl-branched, aliphatic radical containing 8 to 22 and preferably 12 to 18 carbon atoms and G stands for a glycose unit containing 5 or 6 carbon atoms, preferably glucose. The degree of oligomerization x which indicates the distribution of monoglycosides and oligoglycosides is a number of 1 to 10, preferred values for x being 1.1 to 1.4.

Polyhydroxyfatty acid amides correspond to formula (I):

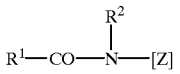

(I)

in which $R^1CO$ is an aliphatic acyl group containing 6 to 22 carbon atoms, $R^2$ is hydrogen, an alkyl or hydroxyalkyl group containing 1 to 4 carbon atoms and [Z] is a linear or branched polyhydroxyalkyl group containing 3 to 10 carbon atoms and 3 to 10 hydroxyl groups. The polyhydroxyfatty acid amides are preferably derived from reducing sugars containing 5 or 6 carbon atoms, more particularly from glucose.

The compositions produced by the process according to the invention typically have bulk densities of about 350 to 750 g/l, preferably in the range from 400 to 720 g/l, more preferably above 450 g/l, but advantageously not above 700 g/l.

As in hitherto unpublished German patent application DE 198 18 966, the bulk densities are preferably below the theoretical weight per liter as determined by the normal method of calculation, the bulk density being variable at least over a certain range for a constant formulation. According to the invention, the normal method of calculation is understood to be the method in which the bulk density of the final product is calculated as described in DE 198 18 966 by adding up the individual bulk densities of each solid raw material or compound weighted by its percentage by weight in the final solid product. The liquid constituents, i.e. the granulation liquid or the granulation liquids, are similarly included with their density.

In one preferred embodiment of the invention, bulk densities making up at most 85% of the theoretical weights per liter as determined by the normal method of calculation are established. Bulk densities which only make up at most 80% and, in particular, only at most 75% of the theoretical weight per liter calculated as described above are preferably established. End products of the process with bulk densities below 650 g/l are particularly preferred.

In another preferred embodiment of the invention, the bulk density is below 700 g/l and more particularly below 650 g/l, even if a bulk density well above 800 g/l had been expected from the normal method of calculation defined above.

In another preferred embodiment of the invention, the compositions produced in accordance with the invention are colored. Aqueous dye solutions or combinations of such dye solutions and a non-aqueous granulation liquid, more particularly nonionic surfactant, are advantageously used for this purpose. In another preferred embodiment of the invention, colored anionic surfactant acids are used either as sole colored product or in addition. In another preferred embodiment of the invention, colored liquid neutralization media are used as sole colored product or in addition.

Mixtures of dye solutions and nonionic surfactants may also be used. In one preferred embodiment of the invention, however, no aqueous dispersions of nonionic surfactants are used. Instead, it is preferred to use at least one other aqueous granulation liquid besides at least one non-aqueous granulation liquid. A particularly preferred embodiment is characterized by the use of nonionic surfactants, perfumes and/or paraffins which are liquid at the process temperature, preferably at temperatures of around room temperature to 60° C. Aqueous liquids and non-aqueous liquids are advantageously used in ratios by weight of 1.5:1 to 1:1.5 and more particularly in ratios by weight of 1.2:1 to 1:1.2.

The agglomeration effect according to the invention is supported by the special mode of operation of the mixer used in accordance with the invention. Particulars of this special mixer can again be found in the disclosure of hitherto unpublished German patent application DE 198 18 966. Above all, relatively small particles and, in particular, fine particles smaller than 100 $\mu$m in diameter are lifted by the movement of the mixer while coarser particles are included in decreasing numbers in the rotational movement of the mixer and, instead, are transported towards the post-mixing zone and then discharged from the mixer into the discharge unit or the feed system, the individual particles being compacted under the effect of their rolling movement. This process is also known as rolling agglomeration or rolling granulation. The particle size beyond which the particles are predominantly subjected to rolling granulation only and are no longer lifted by the movement of the mixer depends to a large extent on the adjustable operating parameters of the mixer, i.e. may be freely adjusted within wide limits in dependence upon the required average and maximum particle size distribution. In particular, a shift towards coarser particles occurs at higher rotational speeds.

The knock-down bar prevents the elevated particles and, in particular, the fine particles from being simply "circulated" because, as soon as they encounter the knock-down bar, these particles are stripped off and drop vertically back down. The geometry of the mixer ensures that the liquid mist sprayed in is sprayed not only onto the freshly added solids, but also directly into this curtain of relatively fine ascending and descending particles. In addition, the knock-down bar prevents the powder from being pressed onto, and adhering to, the walls of the mixer during the rotation thereof. If, nevertheless, caking should occur—and this cannot always be ruled out, depending on the nature of the granulation liquids added and the quantity in which they are added—the knock-down bar acts as a scraper and prevents the caked-on layer from continuing to develop.

Since, as explained above, the liquids are directly sprayed into the moving powder curtain and since—in very approximate terms—these moistened powders only come into contact with the relatively small and fine particles thrown up by the rotation of the mixer, the agglomeration effect occurs in the mixing zone (1) between the moistened powder on the one hand and the relatively small and fine particles on the other hand while overagglomeration through contact of the moistened powder or the residues of liquid components with the already further agglomerated and therefore relatively coarse particles can—roughly speaking—be virtually ruled out. Accordingly, relatively fine particles are agglomerated to form coarser particles which, depending on their size, are thrown up less and less, if at all, by the rotational movement of the mixer (13). In this way, the fine-particle component is minimized along with the coarse particle component because overagglomeration of the relatively coarse particles can very largely be prevented. This is the major advantage of the mixer according to the invention over mixers comprising feeder tools such as, for example, the plowshares in so-called plowshare mixers. The tools penetrate into the material being mixed and agglomerated and, in doing so, carry even relatively coarse particles, "end product", upwards, so that on the one hand the danger of oversize particles being generated increases although, on the other hand, the relatively coarse particles also compete with the smaller particles and above all the fine particles in the agglomeration process, so that the fine-particle component cannot be reduced sufficiently effectively.

In principle, relatively coarse particles can also be elevated and agglomerated in the mixer used in accordance with the invention, the extent to which this happens being greater, the flatter the angle of inclination $\alpha$, the longer the residence time of the material being mixed in the mixer and, as mentioned above, the higher the rotational speed of the mixer. For a possible angle of inclination $\alpha$ of 0 to about 30° at a rotational speed of up to about 70 r.p.m., an angle of inclination of the mixer of 10 to 20° and more particularly 12 to 15° is adjusted in a preferred embodiment of the invention for the reasons mentioned for a rotational speed of the mixer—adjusted through the drive—of 20 to 70 r.p.m. and, more particularly, 30 to 60 r.p.m.

Compositions of the type in question are eminently suitable for use as detergents and also as a compound for a prepared detergent. In another embodiment, therefore, the present invention relates to detergents of which about 50 to 100% by weight consists of a compound or product produced in accordance with the invention.

Accordingly, the detergents or compounds produced in accordance with the invention not only have a relatively variable bulk density, they may also be regarded as extremely stable in storage both in regard to their flow properties and in their reduced or non-existent tendency to separate. The same also applies to bleach and enzyme stability because there is no uncontrolled uptake of water during storage by virtue of the corresponding preferred control of the addition of water during the production process. The particle size distributions of the end products may be adjusted, for example, so that they are largely comparable with those of a substantially spray dried product in which the hydrolysis- and heat-sensitive ingredients were subsequently incorporated. Compared with known granulation processes, the compositions produced in accordance with the invention contain smaller percentages of fine and coarse particles so that a higher product yield is ultimately obtained. Nevertheless, any fine and coarse particles still present may if required be removed by sieving, as in the past. Fine particles may be directly returned to the agglomeration process while coarse particles first have to be separately size-reduced before they can be recycled due to the absence of tools in the mixer. In addition, the products produced in accordance with the invention and the products according to the invention generally show good to very good dispensing behavior in automatic washing machines and also favorable residue behavior on dark-colored textiles which is often better than that of conventionally produced products.

EXAMPLES

26 Parts by weight of a solid compound with the composition shown below were continuously introduced into a mixer according to DE 198 18 966 together with 27.7 parts by weight of sodium sulfate, 18 parts by weight of sodium perborate tetrahydrate, 11 parts by weight of sodium carbonate, 2.2 parts by weight of tetraacetyl ethylenediamine, 2.5 parts by weight of foam inhibitor granules (starch-based silicone oil), 0.8 part by weight of protease granules and 0.5 part by weight of a polymer with a strong influence on the removal of oil and fats from laundry.

23.1% by weight of the solid compound used (produced by granulation) consisted of alkyl benzenesulfonic acid, 3.1% by weight of soap, 57.8% by weight of zeolite A, 11.7% by weight of copolymeric polycarboxylate (sodium salt of acrylic acid and maleic acid), 1% by weight of phosphonate and 0.4% by weight of optical brightener. The rest was water.

4.5 Parts by weight of a typical ethoxylated nonionic surfactant, for example $C_{12-18}$ fatty alcohol containing on average 5 to 7 EO, 0.2 part by weight of perfume and 2 parts by weight of water were sprayed in through separate nozzles as agglomeration aids. 2 Parts by weight of alkyl benzenesulfonic acid and 0.6 part by weight of 50% by weight aqueous sodium hydroxide were sprayed in with air through a three-component nozzle.

Finally, at the end of the mixer, the product was powdered with 2 parts by weight of sodium carbonate.

A drying step was not included. A free-flowing product with a bulk density of 640 g/l was obtained. It showed very favorable dispensing behavior, a very good dissolving rate and good residue behavior on dark-colored fabrics.

TABLE 1

Product data

| Properties | Product |
|---|---|
| Bulk density in g/l | 640 |
| Dispensing test: residue in g | 4.5 |
| Sieve values (% by weight): | |
| on 1.6 mm | 2 |
| on 0.8 mm | 15 |
| on 0.4 mm | 26 |
| on 0.2 mm | 55 |
| on 0.1 mm | 2 |
| through 0.1 mm | 0 |
| Residue score on dark colored fabrics | Less than 3 |
| Storage stability | Free-flowing, no separation |
| Solubility behavior (in %) | 2.6 |

Dispensing test

To determine their dispensing behavior, the compositions were tested in domestic drum-type washing machines with a dispensing drawer under a water pressure of 0.5 bar. The test machines were Miele W918 and Quelle Privileg 110 machines. Five tests were carried out in each machine. The mean value shown below was formed from the 10 results. To this end, quantities of 100 g of the detergents per wash cycle were introduced into the dispensing compartment. The tap water with which the detergents were dispensed into the particular machine loaded with 3.5 kg dry washing had a hardness of 16° d. On completion of the dispensing process, the detergent residues from the dispensing drawer and the dispensing compartment were separately transferred to a watch glass using a rubber wiper and weighed out. 30% of moisture was subtracted from the moist residues. The "dry residues" from the dispensing drawer and the dispensing compartment were added and the average shown in Table 1 was formed from the sum.

Determination of residue behavior on dark-colored fabrics

30 Liters of water were first run into a tub-type washing machine (Arcelik or any comparable type), after which 150 g of the detergent was added and dissolved by stirring. The washing consisting of various dark-colored easy-care delicates of wool, cotton, polyamide and polyacrylonitrile were then introduced into the machine which was subsequently heated to 30° C. After this temperature had been reached, the washing was washed for 10 minutes by actuation of the agitator, after which the wash liquor was drained off and the washing was rinsed three times with 30 liters of water and then spun for 15 seconds. The washing was dried with an infrared heater and evaluated by 5 trained people on the following scale (average values):

score 1: satisfactory, no visible residues score 2: tolerable, isolated, not yet problematical residues score 3: visible residues problematical on critical evaluation score 4 upwards: clearly visible and problematical residues in increasing numbers and quantities.

Determination of solubility behavior (L test)

In order to determine solubility behavior (L test), 8 g of the composition to the tested were scattered while stirring into a 2 liter glass beaker (800 r.p.m. with a laboratory stirrer/propeller stirrer head centrally arranged 1.5 cm from the bottom of the glass beaker) and stirred for 1.5 minutes at 30° C. The test was carried out with water having a hardness of 16° d. The wash liquor was then poured off through a sieve (80 μm). The glass beaker was rinsed out over the sieve with a very little cold water. A double determination was carried out. The sieves were dried to constant weight in a drying cabinet at 40° C.±2° C. and the detergent residue was weighed out. The residue is expressed in percent as the average of the two individual determinations. If the individual results differ by more than 20% from one another, other tests are normally carried out, although this was not necessary in the case of the present tests.

What is claimed is:

1. A process for the production of detersive granules, comprising the steps of introducing into a rotatable mixing container having a circular cross-section one or more solid detergent ingredients, one or more anionic surfactant compounds, said anionic surfactant compound or compounds being at least partly in acid form, and one or more granulation liquids comprising a liquid neutralization medium, wherein said rotatable mixing container has no mixing tools therein and comprises a mixing zone, a post-mixing zone, and a knock-down bar that extends through the entire mixing zone, and mixing and agglomerating said solid detergent ingredient or ingredients, said anionic surfactant compound or compounds, and said one or more granulation liquids in said mixing and post-mixing zones to form a granular detergent composition.

2. The process of claim 1, wherein the knock-down bar also extends at least partially along the length of the post-mixing zone.

3. The process of claim 1, wherein all anionic surfactant compounds except soaps are introduced into the mixing container in acid form.

4. The process of claim 1, wherein the anionic surfactant compound or compounds comprise alkyl benzenesulfonic acid.

5. The process of claim 1, wherein the anionic surfactant compound or compounds are introduced into the mixing container in part in liquid form and in part in solid form.

6. The process of claim 1, wherein the anionic surfactant acid or acids are at least partially neutralized by the liquid neutralization medium introduced into the mixing container.

7. The process of claim 1, wherein at least aliquot molar quantities of an aqueous sodium hydroxide solution are introduced into the mixing container, based on the quantity of anionic surfactant acid or acids introduced into the mixing container.

8. The process of claim 1, wherein the anionic surfactant acid or acids are introduced into the mixing container by spraying in quantities of 0.2% to 20% by weight, based on the granular detergent composition.

9. The process of claim 8, wherein the anionic surfactant acid or acids are introduced into the mixing container by spraying in quantities of 0.5% to 10% by weight, based on the granular detergent composition.

10. The process of claim 9, wherein the anionic surfactant acid or acids are introduced into the mixing container by spraying in quantities of 1% to 6% by weight, based on the granular detergent composition.

11. The process of claim 1, wherein the granulation liquid or liquids are introduced into the mixing container in quantities of 0.5% to 15% by weight, based on the granular detergent composition.

12. The process of claim 11, wherein the granulation liquid or liquids are introduced into the mixing container in quantities of 1% to 10% by weight, based on the granular detergent composition.

13. The process of claim 12, wherein the granulation liquid or liquids are introduced into the mixing container in quantities of 1% to 7% by weight, based on the granular detergent composition.

14. The process of claim 1, wherein the granular detergent composition has a bulk density of at most 85% of theoretical bulk density.

15. The process claim 1, wherein the granular detergent composition has a bulk density of 400 g/l to 720 g/l.

16. The process of claim 15, wherein the granular detergent composition has a bulk density of 450 g/l to 700 g/l.

17. The process of claim 1, wherein one or more colored, aqueous dye solutions are introduced into the mixing container.

18. The process of claim 1, wherein one or more nonionic surfactants are introduced into the mixing container.

19. The process of claim 1, wherein one or more liquid neutralization media are introduced into the mixing container.

20. The process of claim 1, wherein the solid detergent ingredient or ingredients have a water content lower than the water binding capacity of the solid detergent ingredient or ingredients.

21. The process of claim 1, wherein an aqueous granulation liquid is introduced into the mixing container in a quantity that does not exceed the water binding capacity of the remaining ingredients of the granular detergent composition.

22. The process of claim 1, wherein the ratio of the length of the mixing zone to the length of the post-mixing zone is at least 1:1.

23. The process of claim 1, wherein the knock-down bar extends along no more than half the length of the post-mixing zone.

24. The process of claim 1, wherein the knock-down bar has an edge that is disposed at a distance from the inside wall of the mixing container that is at most 10% of the minimum container diameter.

25. The process of claim 24, wherein the knock-down bar has an edge that is disposed at a distance from the inside wall of the mixing container that is at most 5% of the minimum container diameter.

26. The process of claim 1, wherein the mixing container has an axis of rotation having an angle of inclination α of 10° to 20° from horizontal and a variable speed of rotation of 20 to 70 r.p.m.

27. The process of claim 26, wherein the mixing container has an axis of rotation having an angle of inclination α of 12° to 15° from horizontal and a variable speed of rotation of 30 to 60 r.p.m.

28. The process of claim 1, wherein after mixing and agglomeration the granular detergent composition is treated with a surface modifier in the mixing container.

* * * * *